US005542325A

United States Patent [19]

Bane, III

[11] Patent Number: 5,542,325

[45] Date of Patent: Aug. 6, 1996

[54] SHEET CUTTING APPARATUS

[76] Inventor: Wiliam W. Bane, III, 1608 N. Franklin St., Wilmington, Del. 19806

[21] Appl. No.: 297,846

[22] Filed: Aug. 30, 1994

[51] Int. Cl.[6] ..... B27B 3/04

[52] U.S. Cl. ..... 83/415; 83/432; 83/435; 83/435.1; 83/437; 83/468.6; 83/461; 83/751

[58] Field of Search ..... 83/424, 432, 435.1, 83/409, 415, 751, 461, 468.6, 412, 437, 435

[56] References Cited

U.S. PATENT DOCUMENTS

| | | | |
|---|---|---|---|
| 143,895 | 10/1873 | Foley . | |
| 2,786,249 | 2/1957 | Andreae . | |
| 2,807,291 | 9/1957 | Brown | 83/435.1 |
| 2,814,319 | 11/1957 | Hetman . | |
| 3,289,514 | 12/1966 | Rupp . | |
| 3,608,412 | 9/1971 | Braden et al. | 83/432 |
| 3,754,492 | 8/1973 | Krauss . | |
| 3,892,155 | 7/1975 | Gerlach | 83/461 |
| 4,206,672 | 6/1980 | Smith | 83/435.1 |
| 4,372,183 | 2/1983 | Lehtinen | 83/409 |
| 5,050,472 | 9/1991 | Potzsch . | |
| 5,228,376 | 7/1993 | Huang . | |
| 5,435,218 | 7/1995 | Martin | 83/468.6 |

*Primary Examiner*—Kenneth E. Peterson
*Attorney, Agent, or Firm*—Shlesinger, Arkwright & Garvey

[57] ABSTRACT

A cutting device for cutting sheet material having an elongated work table disposed on a base support. The work table if for supporting the sheet material to be cut and includes a first and second portion, and a center portion, with the center portion rigidly secured to the base support and positioned between the first and second portions. A first saw is operably associated with the center portion and the base support. The first and second end portions are movable relative to the center portion, such that the sheet material disposed on the work table is movable relative to the first saw thereby permitting the cutting of the sheet material. A guide for positioning the sheet material relative to the work table is positioned along the first and second end portions. A clamp is mounted to the first end portion of the work table for holding down the sheet material on the work table during cutting, the clamp has an engaged and a disengaged position relative to the sheet material. An actuator is operably associated with the clamp for moving the clamp between the engaged and the disengaged positions.

16 Claims, 9 Drawing Sheets

SHEET CUTTING APPARATUS

FIELD OF THE INVENTION

The present invention relates generally to a sheet cutting apparatus, and more specifically to a reciprocating table saw adapted for dustless miter joint cutting of both ridged and flexible foam sheet material.

BACKGROUND OF THE INVENTION

There are a variety of uses for foam sheet material, one such use is to line the inside of cardboard shipping containers with miter cut foam sheets. These miter cut foam sheets add rigidity and structural stability to the shipping container and protect the contents being shipped. Certain types of foam also prove to be very good insulators for chilled or frozen materials as well as for warm or hot materials, thus enabling thermal sensitive materials to be shipped safely and inexpensively. Examples of such thermal sensitive materials include a variety of medical supplies such as blood, transplant organs, hazardous waste, and infectious material.

Prior art cutting devices for foam sheet material are known. These devices either fail to provide a clamping mechanism to hold the sheet material during cutting, or the clamping mechanisms are inadequate or damage the foam sheet material. In addition, the prior art devices create substantial amounts of foam dust during operation. Further, many of the prior art devices have poor length gauge mechanisms or saws that do not provide accurate and consistent cutting.

OBJECTS AND SUMMARY OF THE INVENTION

It is therefore an object of the present invention to provide a device for cutting sheet material in which the sheet material can be quickly and efficiently measured, clamped, and miter cut.

It is another object of the present invention to provide a device for cutting sheet material with a clamping mechanism which does not damage the sheet material and retains the sheet material in the proper cutting position and prevents shifting during cutting.

It is yet another object of the present invention to provide a device for cutting sheet material with a pneumatic clamping mechanism which quickly clamps and quickly releases the sheet material providing far more efficient cutting.

It is still another object of the present invention to provide a device for cutting sheet material with a reciprocating saw having a scalloped blade which virtually eliminates the creation of any foam dust during the cutting of the sheet material.

It is yet another object of the present invention to provide a device for cutting sheet material with two miter saws for simultaneous mitered section cuts of the sheet material.

It is still another object of the present invention to provide a device for cutting sheet material with an adjustable stop mechanism to quickly gage the length of the sheet material to be cut.

It is another object of the present invention to provide a device for cutting sheet material with a stationary saw and movable work table for moving the sheet material to be cut into the saw providing a quick, clean cut.

It is yet another object of the present invention to provide a device for cutting sheet material which can readily cut sheet material with a thickness ranging from ¼ inch to 4 inches.

It is another object of the present invention to provide a device for cutting sheet material with retractable wheels for easy transportation of the device.

In summary, the present invention is directed to a cutting device for cutting sheet material comprising a base support and an elongated work table mounted to the base support for supporting the sheet material to be cut. The work table is provided with first and second end portions and a center portion. A saw is operably associated with the center portion and the base support. The first and second end portions are movable with respect to the center portion and the saw, permitting the sheet material disposed on the work table to be movable with respect to the saw thereby permitting the cutting of the material. A guide is also provided along the first and second end portions for positioning the sheet material to be cut relative to the work table. A clamp mounted to the first end portion is provided having an engaged position to hold down the sheet material to be cut on the work table, and a disengaged position permitting the sheet material to be moved upon the work table. An actuator operably associated with the clamp is provided for moving the clamp between the engaged and disengaged positions.

The present invention is also directed to a cutting device for cutting sheet material comprising a base support and an elongated work table mounted to the base support for supporting the sheet material to be cut. The work table is provided with first and second end portions and a center portion. A saw with a reciprocating scalloped blade is operably associated with the center portion and the base support. The first and second end portions are movable with respect to the center portion and the saw, permitting the sheet material disposed on the work table to be movable with respect to the saw thereby permitting the cutting of the material. A guide is also provided along the first and second end portions for positioning the sheet material to be cut relative to the work table. A clamp mounted to the first end portion is provided having an engaged position to hold down the sheet material to be cut on the work table, and a disengaged position permitting the sheet material to be moved upon the work table. An actuator operably associated with the clamp is provided for moving the clamp between the engaged and disengaged positions.

The present invention is further directed to a cutting device for cutting sheet material comprising a base support and an elongated work table mounted to the base support for supporting the sheet material to be cut. The work table is provided with first and second end portions and a center portion. First and second saws operably associated with the center portion and the base support are also provided with the cutting portion of the first saw being positioned at approximately a 45 degree angle with respect to the work table and the cutting portion of the second saw being positioned at approximately a 45 degree angle with respect to the work table and approximately a 90 degree angle with respect to the first saw. The first and second end portions are movable with respect to the center portion and the first and second saws, permitting the sheet material disposed on the work table to be movable with respect to the first and second saws thereby permitting the cutting of the material. A guide is also provided along the first and second end portions for positioning the sheet material to be cut relative to the work table. A clamp mounted to the first end portion is provided having an engaged position to hold down the sheet material to be cut on the work table, and a disengaged position permitting the sheet material to be moved upon the work table. An actuator operably associated with the clamp is provided for moving the clamp between the engaged and disengaged positions.

These and other objects and advantages of the present invention will become apparent from a consideration of the following detailed description taken in conjunction with the accompanying drawings.

BRIEF DESCRIPTIONS OF THE DRAWINGS

Figure 10:
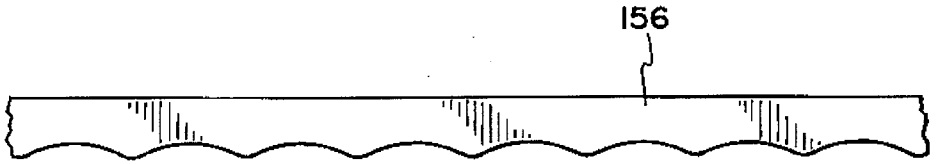
Figure 9A:
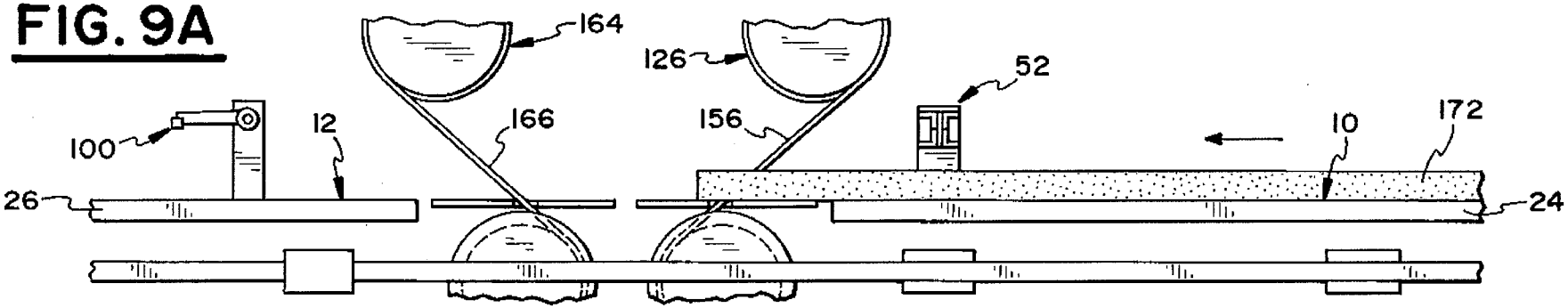
Figure 9B:
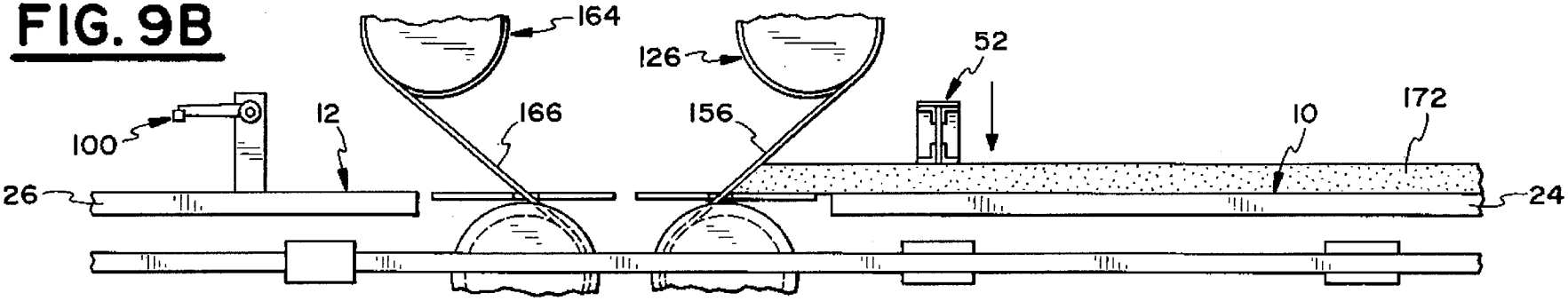
Figure 9C:
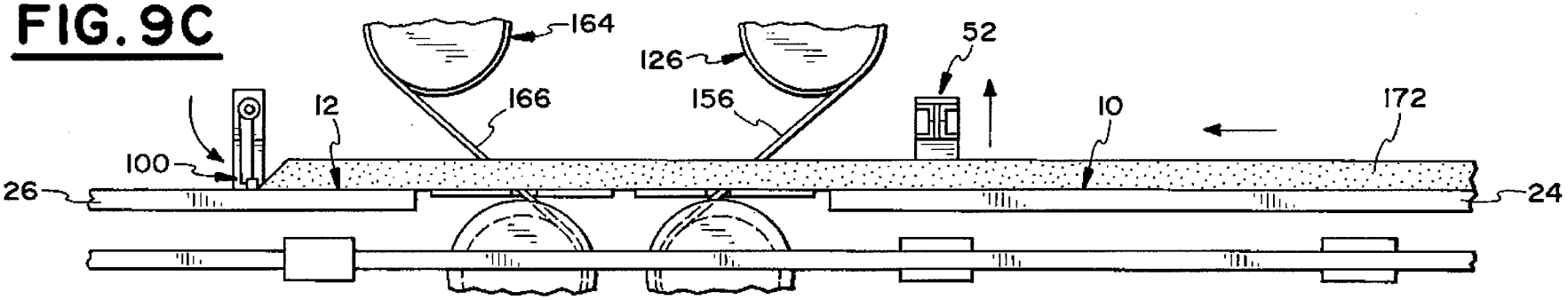

FIG. 9A through 9C illustrates the cutting of sheet material on the present invention. FIG. 9A illustrates the sheet material moved in the direction of the arrow to a first cutting position, FIG. 9B illustrates the clamp moved in the direction of the arrow holding the sheet material to the work table and a first cut of the sheet material, FIG. 9C illustrates the clamp moving in the direction of the arrow releasing the sheet material, the stop moving in the direction of the arrow and then the sheet material moved to the stop into a second cutting position; and FIG. 10 is an enlarged fragmentary plan view of a cutting blade of the invention shown in FIG. 1.

DETAILED DESCRIPTION OF THE INVENTION

Figure 1:
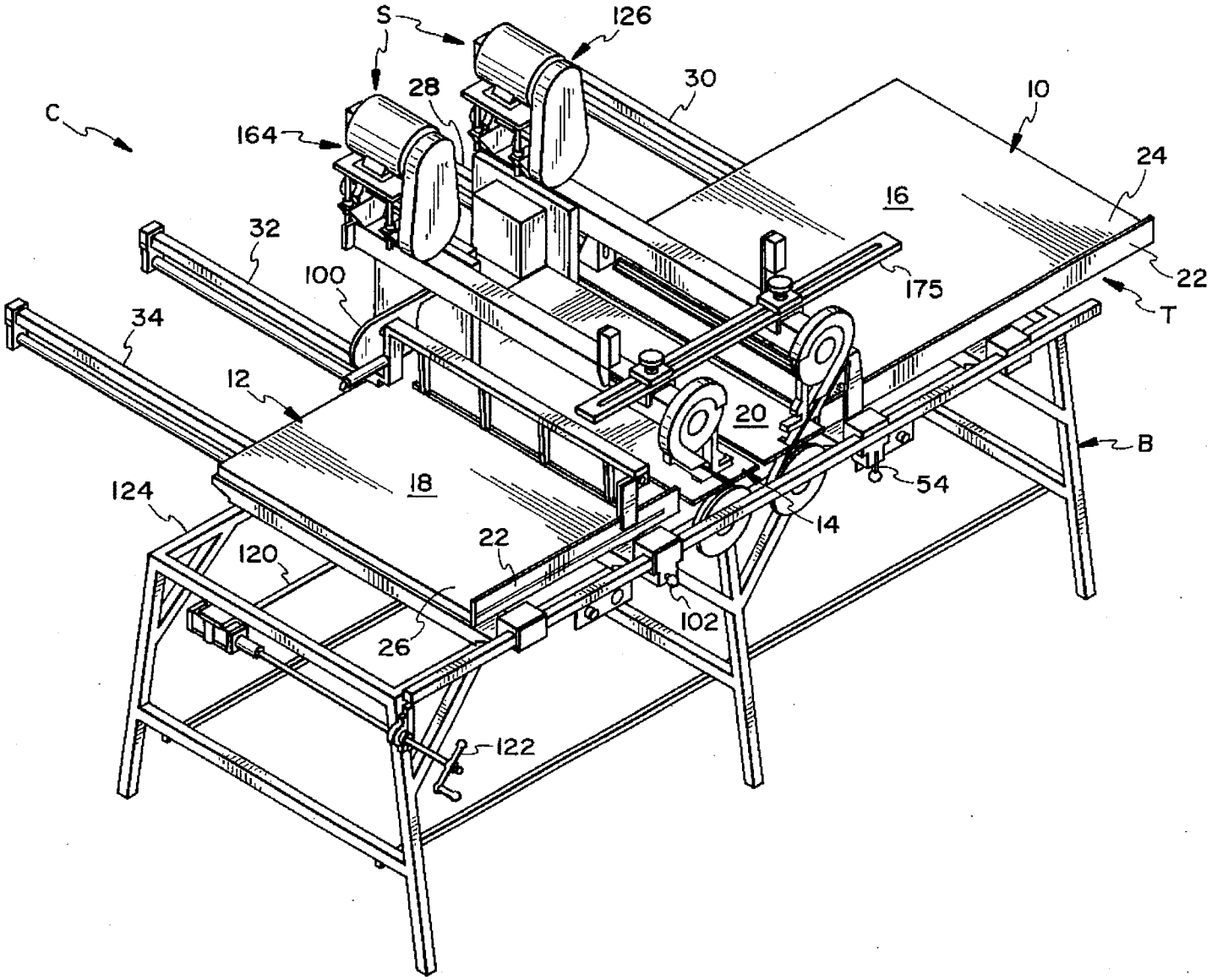
FIG. 1 is a perspective view of a preferred embodiment of the present invention.

Referring now to FIG. 1, the cutting device C according to the present invention can be seen as comprising an elongated work table T supported by a base support B, and saws S which are supported by work table T and base support B.

The work table T includes a feed end or a first end portion 10, an exit end or a second end portion 12, and a cutting section or a center portion 14. The center portion 14 is fixed to base support B and is positioned between the first and second end portions 10 and 12. The upper surfaces 16 and 18 of the first and second end portions 10 and 12, and the upper surface 20 of the center portion 14 lie in a single horizontal plane allowing the sheet material to be easily slid from one section to the other. A guide 22 traverses the front edges 24 and 26 of the first and second end portions 10 and 12 against which sheet material to be cut may be pressed in side engagement.

Figure 4:
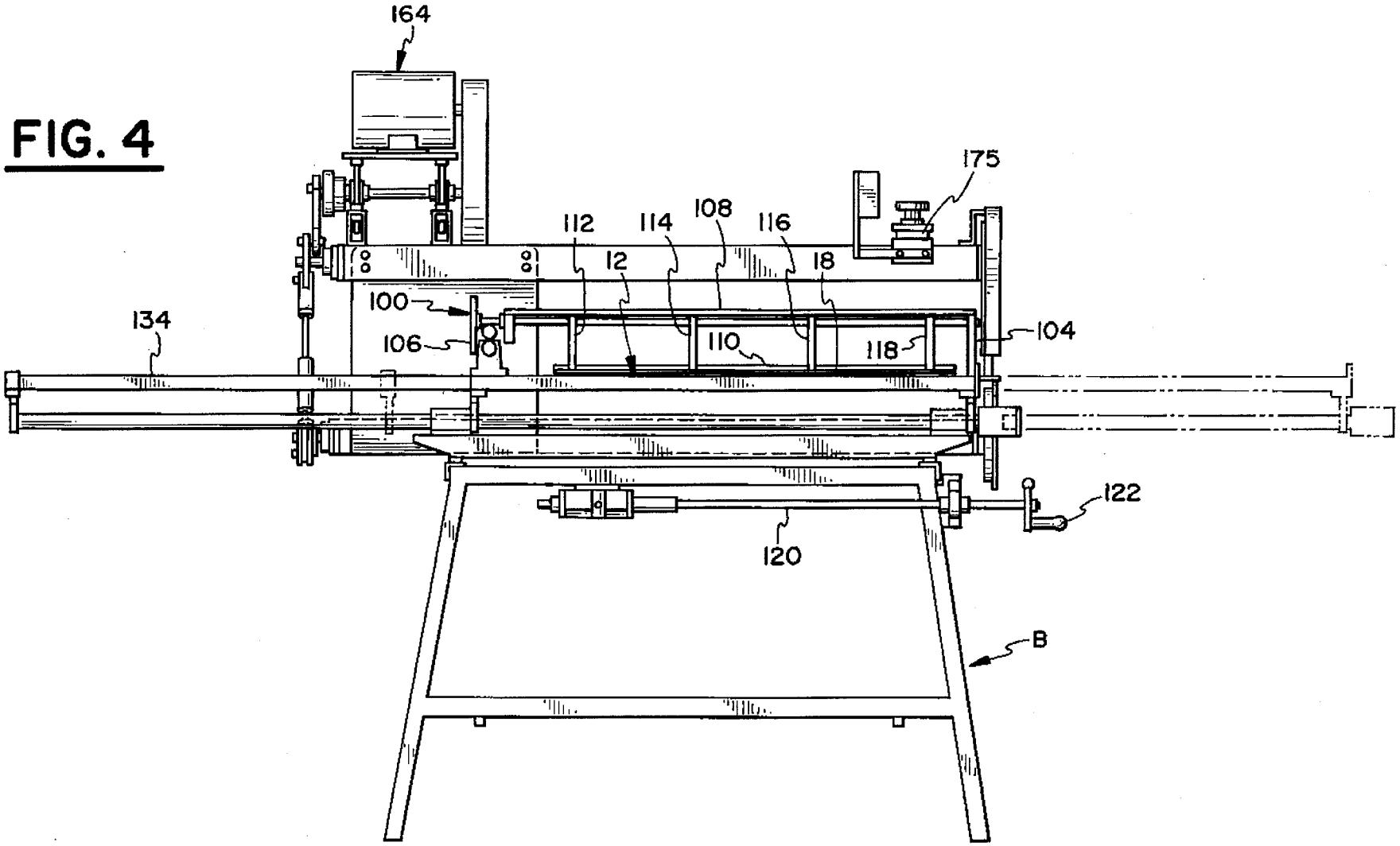
FIG. 4 is a side elevational view of the left end of the present invention shown in FIG. 1 and showing the movement of the end portions of the work table.

Rails 28, 30, 32, and 34 are attached to the bottom of the first and second end portions 10 and 12. Rails 28 and 30 of the first end portion 10 engage bearing units 36, 38, 40, and 42 (FIGS. 2 & 5), which are mounted to base support B. Rails 32 and 34 of the second end portion 12 engage bearing units 44, 46, 48, and 50 (FIGS. 2 & 5), which are movably mounted to base support B. The bearing units enable the first and second end portions 10 and 12 to be simultaneously moved upon their rails 28, 30, 32, and 34 forward and backward with respect to the front edges 24 and 26 of the first and second end portions 10 and 12 (FIG. 4).

Figure 2:
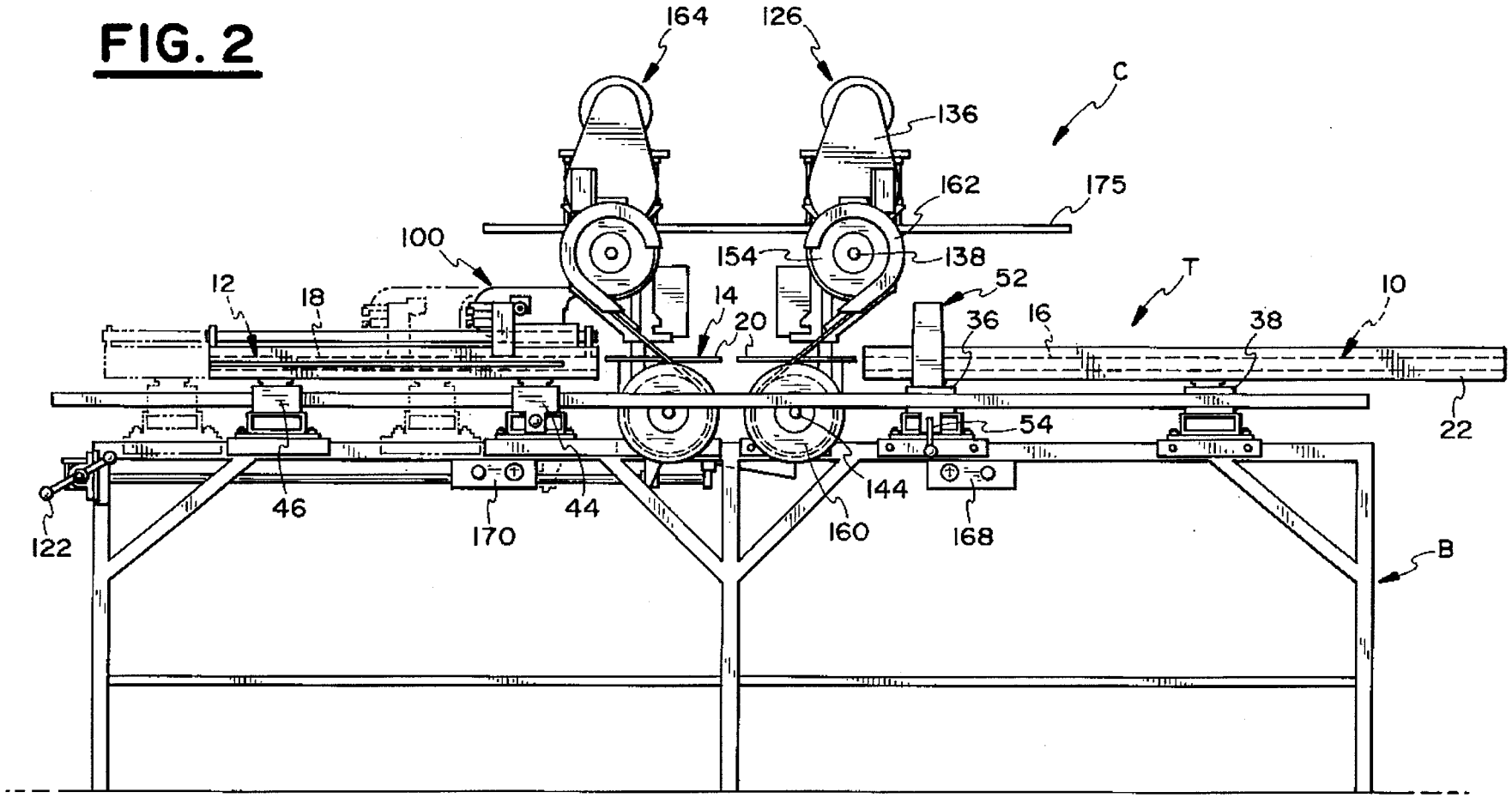
FIG. 2 is a front elevational view of the present invention shown in FIG. 1 and showing the lateral movement of the second end portion.
Figure 3:
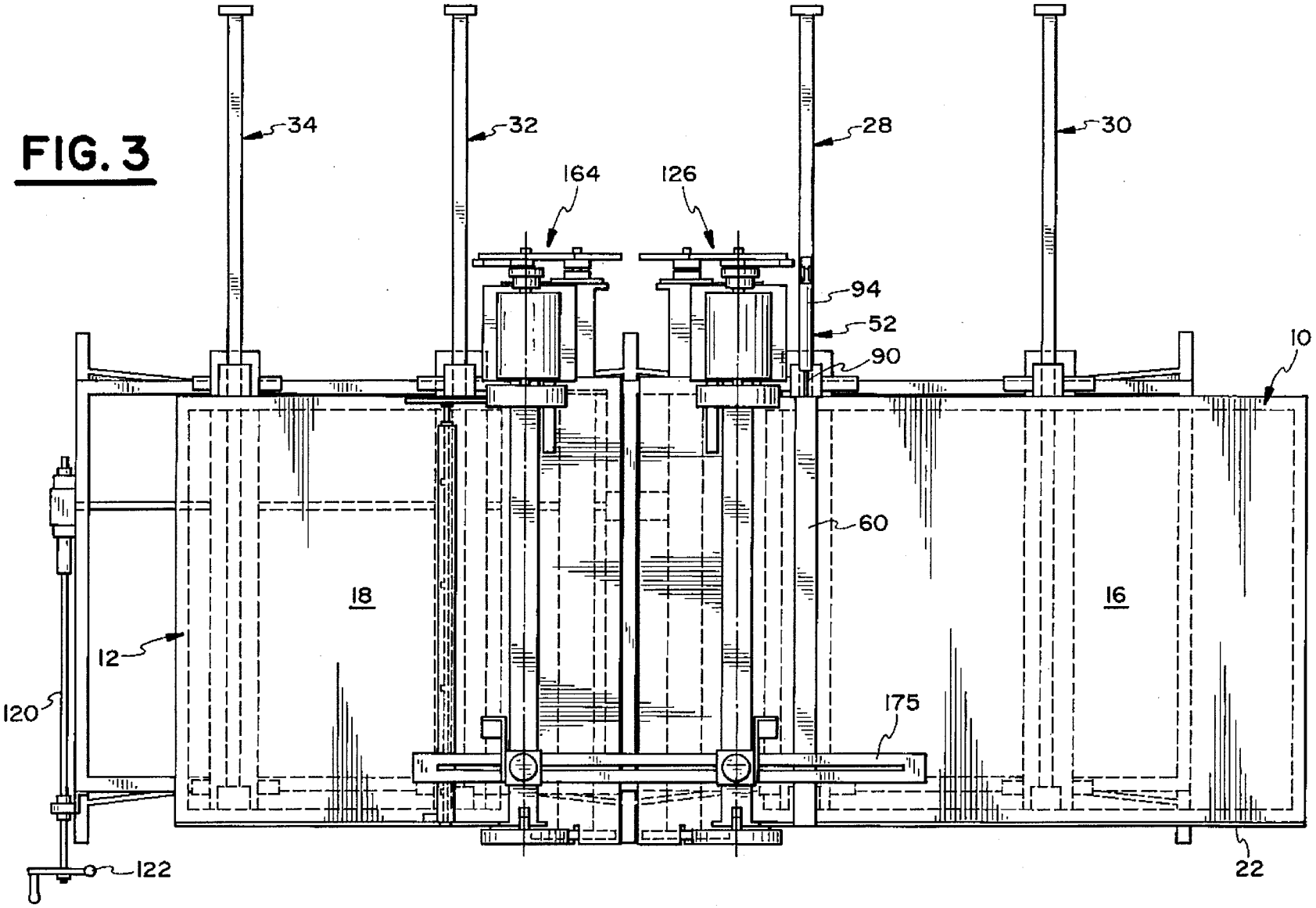
FIG. 3 is a top plan view of the present invention shown in FIG. 1.
Figure 8:
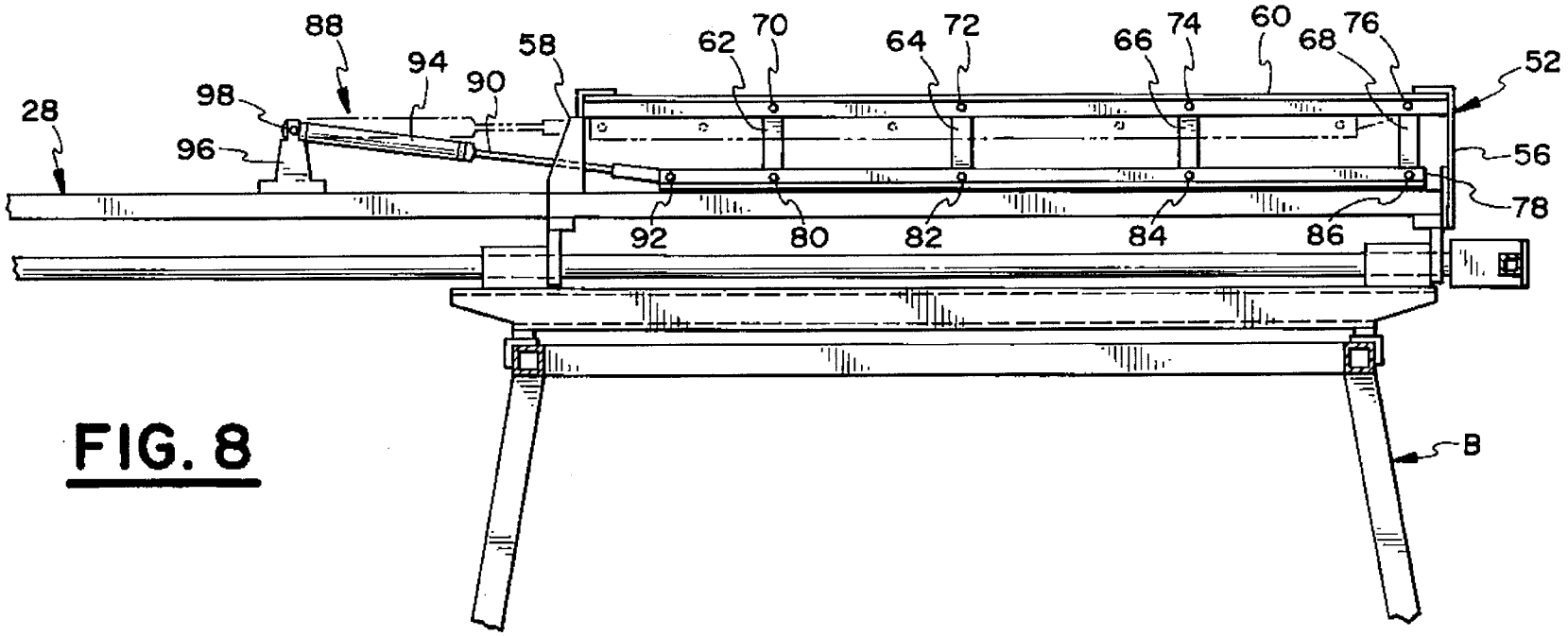
FIG. 8 is a vertical section of the present invention taken along line 8—8 of FIG. 7.

As best shown in FIG. 8, a clamping mechanism 52 for holding the sheet material to be cut, is mounted to the first end portion 10 and rail 28, transverse to work table T. Clamping mechanism 52 is activated and deactivated by switching clamp lever 54 (FIG. 2).

Brackets 56 and 58 are mounted at the front and rear edges of first end portion 10 and secure support 60. First ends of links 62, 64, 66, and 68 are pivotally connected to support 60 by pins 70, 72, 74, and 76. A clamp bar 78 is pivotally connected to the second ends of links 62, 64, 66, and 68 by pins 80, 82, 84, and 86. Clamp bar 78 includes a generally flat surface 79 for engaging the sheet material to be cut. Flat surface 79 is positioned in a plane generally parallel to upper surface 16 of first end portion 10.

A pneumatic operated piston-cylinder assembly 88 is used to raise and lower clamp bar 78. One end of piston 90 is pivotally connected to clamp bar 78 by pin 92. Cylinder 94 is pivotally connected to cylinder support 96 by pin 98, cylinder support 96 being mounted to rail 28. When piston-cylinder assembly is deactivated, piston 90 is retracted into cylinder 94 causing clamp bar 78, positioned parallel with upper surface 16 to swing up adjacent to support 60. When piston-cylinder assembly 88 is activated, piston 90 is extended from cylinder 94 causing clamp bar 78 to swing down and away from support 60. Links 62, 64, 66, and 68 swing up and down with clamp bar 78 maintaining clamp bar's 78 parallel position with upper surface 16.

Figure 6:
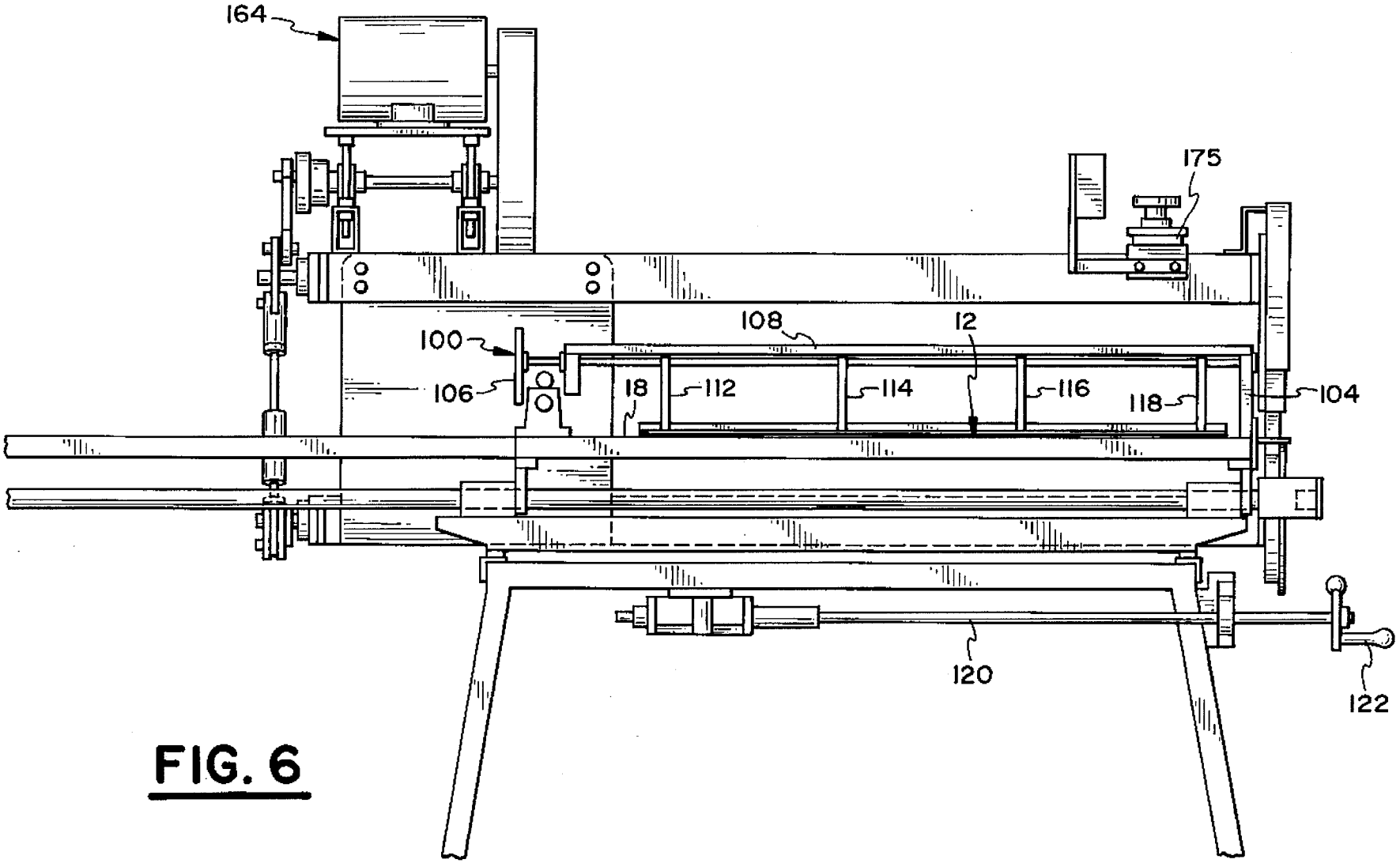
FIG. 6 is an enlarged side elevational view of the left end of the present invention as similarly shown in FIG. 4, with portions of the table broken away.

As best shown in FIGS. 4, 6 and 9, a stop 100, used to gauge the length of the portion of the sheet material to be cut, is mounted to second end portion 12, transverse to work table T. Stop 100 is activated and deactivated by switching stop lever 102.

Brackets 104 and 106 are mounted on the front and rear sides of second end portion 12 and pivotally secure stop support 108. A stop bar 110 is positioned parallel to upper surface 18 and is secured to stop support 108 by links 112, 114, 116, and 118. When deactivated, stop support 108 and stop bar 110 lie in a plane substantially parallel to and above upper surface 18 (FIG. 9A and 9B). When activated, stop bar 110 swings down (FIG. 9C) to a position such that stop support 108 and stop bar 110 lie in a plane substantially perpendicular to upper surface 18, with stop bar 110 being positioned slightly above upper surface 18. In a preferred embodiment, stop bar 110 is generally cylindrical in shape to allow the mitered edge of the sheet material to be partially inserted under stop bar 110 thereby helping to prevent the sheet material from raising or shifting during cutting.

As shown in FIG. 2, second end portion 12 can be moved laterally with respect to center portion 14, thereby permitting the adjustment of the position of stop 100. A crank shaft 120 is connected to second end portion 12 such that when hand crank 122 is turned, the second end portion 12 moves laterally with respect to center portion 14, with bearing units 44, 46, 48, and 50 sliding upon frame member 124 of base support B.

Figure 5:
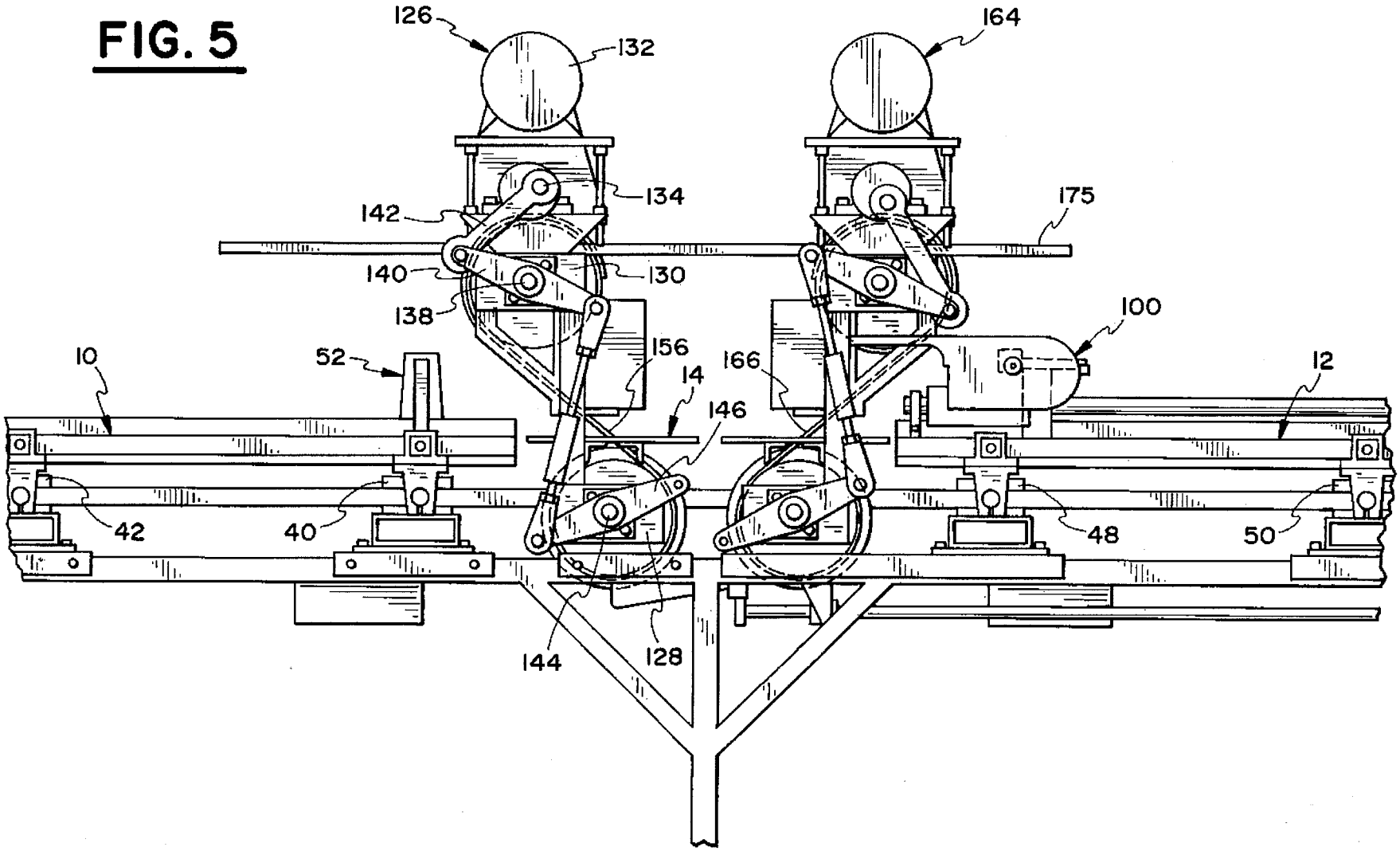
FIG. 5 is an enlarged rear elevational view of the present invention shown in FIG. 1, with portions of the table broken away.

As best shown in FIG. 5, a first reciprocating saw 126 is mounted to the work table T and the center portion 14. The lower rear portion of saw 126 is mounted to center portion 14 and work table T by lower rear mounting bracket 128, while the upper rear portion of saw 126 is mounted to center portion 14 and work table T by upper rear mounting bracket 130, offset from the lower rear portion of saw 126. The upper rear portion of saw 126 includes a motor 132 secured to the top of upper rear mounting bracket 130. Motor 132 powers drive shaft 134 which is mounted below motor 132. A protective housing 136 is connected to the front portions of motor 132 and drive shaft 134. An upper axle 138, which traverses the width of the work table T, is mounted to upper rear bracket 130, below drive shaft 134. Upper oscillator arm 140 is center connected to the rear end of upper axle 138. A first end of upper oscillator arm 140 is pivotally connected to drive shaft 134 by an upper connector arm 142. A lower axle 144, which traverses the width of the work table T, is mounted to lower rear mounting bracket 128. Lower oscillator arm 146 is center connected to the rear end of lower axle 144. Lower connector arm 148 is pivotally connected to one end of lower oscillator arm 146 and to a second end of upper oscillator arm 140.

Figure 7:
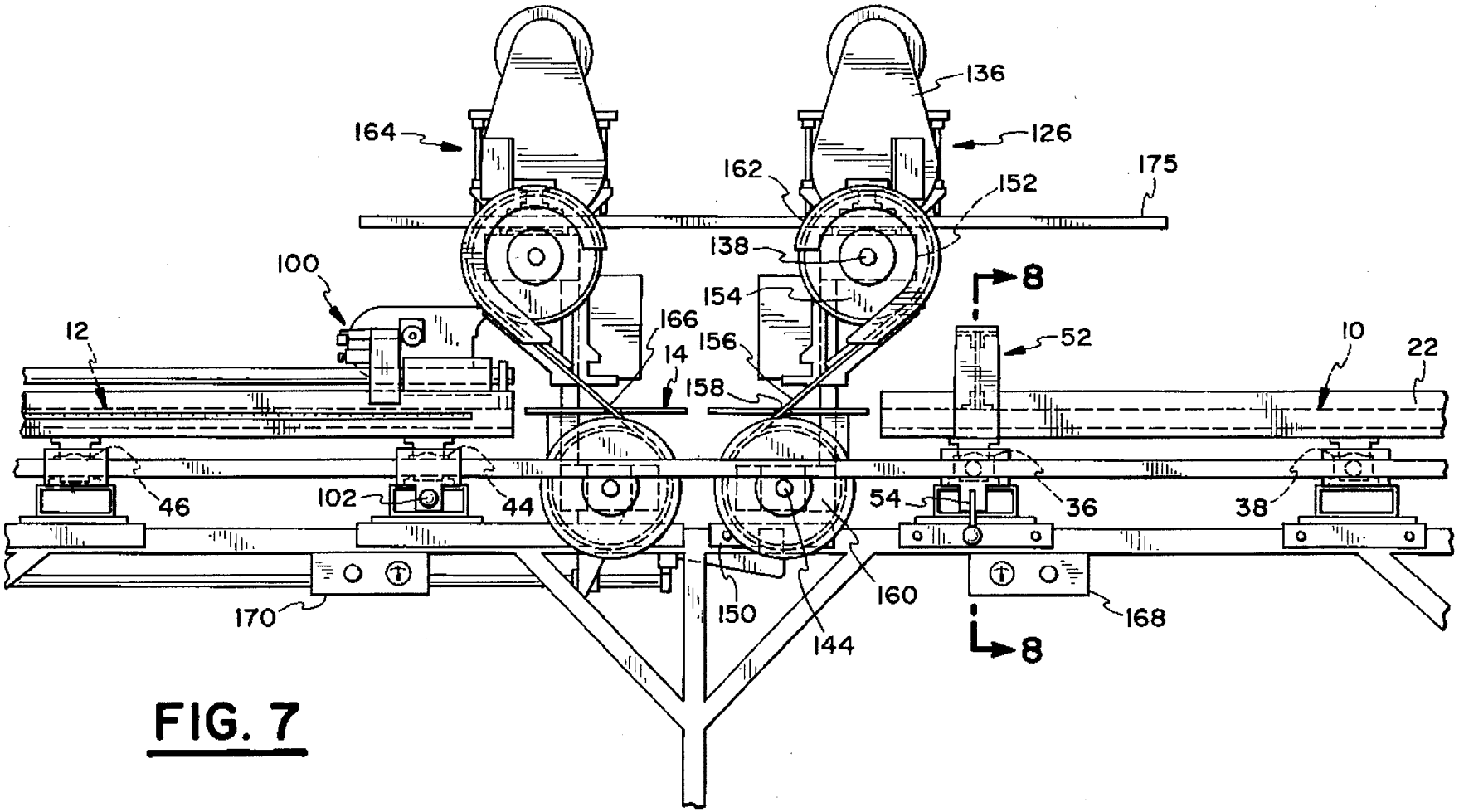
FIG. 7 is a enlarged front elevational view of the present invention as similarly shown in FIG. 2, with portions of the table broken away.

As best shown in FIGS. 2 & 7, the lower front portion of saw 126 is mounted to center portion 14 and work table T by lower front mounting bracket 150, while the upper front portion of saw 126 is mounted to center portion 14 and work table T by upper front mounting bracket 152. An upper oscillating disc 154 is mounted to the front end of upper axle 138 and a lower oscillating disc 160 is mounted to the front end of lower axle 144. A first end of blade 156 is attached to the outer circumference of upper oscillating disc 154. Blade 156 extends from upper oscillating disc 154 at approximately a 45 degree angle with respect to work table T, through slot 158 in center portion 14, to lower oscillating disc 160 where the second end of blade 156 is attached to the outer circumference of lower oscillating disc 160. A guide 153 is attached to upper front mounting bracket 152 and includes a roller 155. Guide 153 prevents blade 156 from deviating from its cutting path thereby ensuring a straight cut and further prevents buckling of blade 156 when oscillating. Roller 155 allows the sheet material being cut to be moved smoothly over blade 156 and also prevents the sheet material from lifting off center portion 14.

A safety feature included on the present invention is a blade guard 162 that covers the portion of the blade 156 attached to upper oscillating disc 154. Blade guard 162 further extends over blade 156 and can be adjusted to expose only the minimum length of the blade necessary for cutting the specific thickness of sheet material. In a preferred embodiment, blade 156 has a scalloped cutting edge (FIG. 10) to reduce the amount of dust generated while cutting the foam sheet material.

As best shown in FIGS. 5 & 7, actuation of drive shaft 134 by motor 132 causes upper and lower arms 140 and 146 to oscillate, which in turn oscillates upper and lower axles 138 and 144 and upper and lower oscillating discs 154 and 160 to move blade 156 creating a preferred cutting motion.

As best shown in FIGS. 5 and 7 a second reciprocating saw 164 is similarly mounted to the work table T and the center portion 14. Second reciprocating saw 164 is a mirror structure of first reciprocating saw 126, with blade 166 positioned at an angle of approximately 45 degrees with respect to the work table T and at an angle of approximately 90 degrees with respect to blade 156 of first reciprocating saw 126. Stabilizer bar 175 connects first reciprocating saw 126 and second reciprocating saw 164 helping to maintain a consistent position of blades 156 and 166 providing a more consistent and accurate cut of the sheet material.

As best shown in FIGS. 9A to 9C, to operate cutting device C, the operator (not shown) switches on reciprocating saws 126 and 164 at control panels 168 and 170 (FIG. 7). Stop 100 is deactivated by stop lever 102 and clamp mechanism 52 is deactivated by clamp lever 54. The first and second end portions 10 and 12 are pulled towards the operator, after which a piece of sheet material 172 is placed flat on the first end portion 10 with a first end extending slightly beyond blade 156 (FIG. 9A) and the side of the sheet material pressed against guide 22. Clamping mechanism 52 is activated at clamp lever 54, moving the flat surface 79 of clamp bar 78 into a position of engagement with sheet material 172, thereby holding sheet material 172 in place (FIG. 9B). The first and second end portions 10 and 12 are pushed away from the operator causing blade 156 to make an initial miter cut on the end portion of sheet material 172.

The first and second end portions 10 and 12 are then pulled toward the operator and the clamping mechanism 52 is deactivated releasing sheet material 172. Stop 100 is activated and the sheet material 172 is moved over center portion 14 until it engages stop 100 on second end portion 12. Clamping mechanism 52 is again activated, holding down sheet material 172. The first and second end portions 10 and 12 are pushed away from the operator causing blades 156 and 166 to make two miter cut sections of sheet material 172. The stop 100 is deactivated and the cut sections are then removed. Additional mitered sections are cut by repeating the above procedure, While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A cutting device for cutting sheet material comprising:

a) a base support;

b) an elongated work table disposed on said base support for supporting the sheet material to be cut;

c) said work table including first and second end portions and a center portion;

d) said center portion rigidly secured to said base support and positioned between said first and second end portions;

e) a first saw operably associated with said center portion and said base support;

f) said first and second end portions movable relative to said center portion such that the sheet material disposed on said work table is movable relative to said first saw to permit cutting of the sheet material;

g) a guide positioned along said first and second end portions for positioning the sheet material relative to said work table;

h) a clamp mounted to said first end portion of said work table for holding down the sheet material on said work table, said clamp having engaged and disengaged positions relative to the sheet material;

i) an actuator operably associated with said clamp for moving said clamp between said engaged and disengaged positions;

j) a stop mounted to said second end portion of said work table for engaging the sheet material at a predetermined location;

k) said stop rotatable to a position closely overlying said work table and retractable therefrom, and l) said second end portion movable along a second direction relative to said center portion for permitting the adjustment of the location of said stop relative to said center portion.

2. A cutting device as in claim 1, wherein:

a) said clamp includes a support and a clamp bar; and b) said clamp bar is movably connected to said support such that said clamp bar is closely overlying said work table when said clamp is in said engaged position and said clamp bar is retracted therefrom when said clamp is in said disengaged position.

3. A cutting device as in claim 2, wherein:

a) said support includes a link, said link having first and second ends; and b) said first end of said link is pivotally connected to said support and said second end of said link is pivotally connected to said clamp bar.

4. A cutting device as in claim 2, wherein:

a) said clamp bar includes a generally planar surface; and b) said planar surface is positioned substantially parallel to said work table for providing generally uniform contact and pressure with the sheet material when said clamp is in said engaged position.

5. A cutting device as in claim 2, wherein:

a) said actuator includes a fluid operated piston-cylinder assembly; and b) said piston-cylinder assembly is pivotally connected to said clamp bar for permitting said clamp to be moved to said engaged and said disengaged positions.

6. A cutting device as in claim 1, wherein:

a) each of said first and second end portions includes a rail for providing simultaneous movement of said first and second end portions along a first direction relative to said center portion.

7. A cutting device as in claim 6, wherein:

a) said first saw includes a reciprocating scalloped blade.

8. A cutting device as in claim 7, wherein:

a) said scalloped blade of said first saw is positioned non-perpendicular to said work table.

9. A cutting device as in claim 7, wherein:

a) said scalloped blade of said first saw is positioned at an angle of approximately 45 degrees with respect to said work table.

10. A cutting device as in claim 1, and further comprising:

a) a second saw operably associated with said center portion and said base support.

11. A cutting device as in claim 10, wherein:

a) said second saw includes a reciprocating scalloped blade.

12. A cutting device as in claim 11, wherein:

a) said scalloped blade of said second saw is positioned non-perpendicular to said work table.

13. A cutting device as in claim 11, wherein:

a) said scalloped blade of said second saw is positioned at an angle of approximately a 45 degrees with respect to said work table.

14. A cutting device as in claim 10 and including:

a) a stabilizing bar 175 connecting said first and second saws to maintain said first and second saws in position.

15. A cutting device as in claim 14 and wherein:

a) said stabilizing bar 175 is adjustable.

16. A cutting device as in claim 1, and further comprising:

a) a second saw operably associated with said center portion and said base support;

b) each of said first and second saws includes a reciprocating scalloped blade;

c) said scalloped blade of said first saw is positioned at an angle of approximately 45 degrees with respect to said work table; and d) said scalloped blade of said second saw is positioned at an angle of approximately 45 degrees with respect to said work table and at an angle of approximately 90 degrees with respect to said scalloped blade of said first saw.

* * * * *